US006948586B1

(12) United States Patent
Saucedo

(10) Patent No.: US 6,948,586 B1
(45) Date of Patent: Sep. 27, 2005

(54) QUICK RELEASE RAPPEL DEVICE

(75) Inventor: Kent D. Saucedo, Tempe, AZ (US)

(73) Assignee: Axian Technology, Inc., Phoenix, AZ (US)

( * ) Notice: Subject to any disclaimer, the term of this patent is extended or adjusted under 35 U.S.C. 154(b) by 0 days.

(21) Appl. No.: 10/440,686

(22) Filed: May 19, 2003

(51) Int. Cl.[7] ..... A47L 3/04
(52) U.S. Cl. ..... 182/5; 182/72; 182/193; 188/65.3
(58) Field of Search ..... 182/3, 5, 7, 9, 182/72, 193, 197, 42; 188/65.3

(56) References Cited

U.S. PATENT DOCUMENTS 642,889 A * 2/1900 Whitner ..... 182/5
2,686,074 A * 8/1954 Meighan ..... 294/75
4,019,609 A * 4/1977 Wagner ..... 188/65.4
4,542,884 A * 9/1985 Dodge, Jr. ..... 254/391
4,678,059 A * 7/1987 Bowker ..... 182/5
5,029,669 A * 7/1991 Lew et al. ..... 182/42
5,038,888 A * 8/1991 Varner et al. ..... 182/5
5,873,432 A * 2/1999 Cho ..... 182/72
5,954,153 A * 9/1999 Rogelja ..... 182/5
6,059,072 A * 5/2000 Cho ..... 182/193
6,079,518 A * 6/2000 Cho ..... 182/193
6,131,697 A * 10/2000 Bassett ..... 182/5
6,561,313 B2 * 5/2003 Hewlett et al. ..... 182/5
6,681,891 B2 * 1/2004 Richard et al. ..... 182/5
6,793,046 B2 * 9/2004 Petzl et al. ..... 188/188

* cited by examiner

*Primary Examiner*—Bruce A. Lev
(74) *Attorney, Agent, or Firm*—Frank J. McGue

(57) ABSTRACT

A rappel device is used in rapidly descending from a height using a rope and then quickly disengaging from the rope. The rappel device comprises a body having a rim which defines a rope opening therein. The body is further adapted to be affixed to a harness. A lock extends across the rope opening. The lock frictionally engages a rope extending through the rope opening. A retracting mechanism manually releases the lock from engagement with the rope. The retracting mechanism is biased to a secured position whereby the lock is engaged with the rope. The retracting mechanism, when actuated, manually releases the lock to an open position whereby the rope is quickly released from the lock.

4 Claims, 3 Drawing Sheets

QUICK RELEASE RAPPEL DEVICE

TECHNICAL FIELD

This invention relates generally to the field of rappel devices, and, more particularly, to a quick release rappel device.

BACKGROUND OF THE INVENTION

Often time, climbers, rescue and military personnel will want to move quickly from a high location such as a building, a helicopter or a cliff to a lower location such as the ground or a ledge. At present, the preferred method for such a rapid descent is to rappel down. Presently, to rappel, a rope is secured to an anchor and through a descending device located on an individual's harness typically connected to the individual with a carabiner. The individual holds the rope in one hand preferably positioned behind the body to control the speed of the descent. Friction devices such as a figure eight descender are used to provide control and safety in the rappel.

However, the current methods do not allow for a quick release from the rope once the descent is completed. Often, such quick release may be very desireable.

For example, often special forces troops rappel from a helicopter to an objective. To minimize danger, those troops need to be able to rappel to the ground, detach from the rope and move away as quickly as possible from under the helicopter. In a rescue situation, a helicopter may not provide the most stable platform for a paramedic if the winds are very high or gusty. Thus, once the paramedic reaches a position proximate to an injured hiker or climber, that paramedic will want to quickly disengage from the moving helicopter to aviod being dragged about by those winds.

The difficulty of detaching relates to the need to disengage two devices, namely, the carabiner and the friction device, from the rope. Disengagement also may require slack in the rope which may be difficult to obtain in the previously described situations. Thus, there is a need for a quick release rappel device.

None of the known prior art disclose the combination set forth herein.

SUMMARY OF THE INVENTION

It is an object of this invention to provide a rappel device which allows for quick release from a rope.

Further objects and advantages of the invention will become apparent as the following description proceeds and the features of novelty which characterize this invention will be pointed out with particularity in the claims annexed to and forming a part of this specification.

BRIEF DESCRIPTION OF THE DRAWINGS

The present invention may be more readily described by reference to the accompanying drawings in which.

DESCRIPTION OF THE PREFERRED EMBODIMENT

Figure 1:
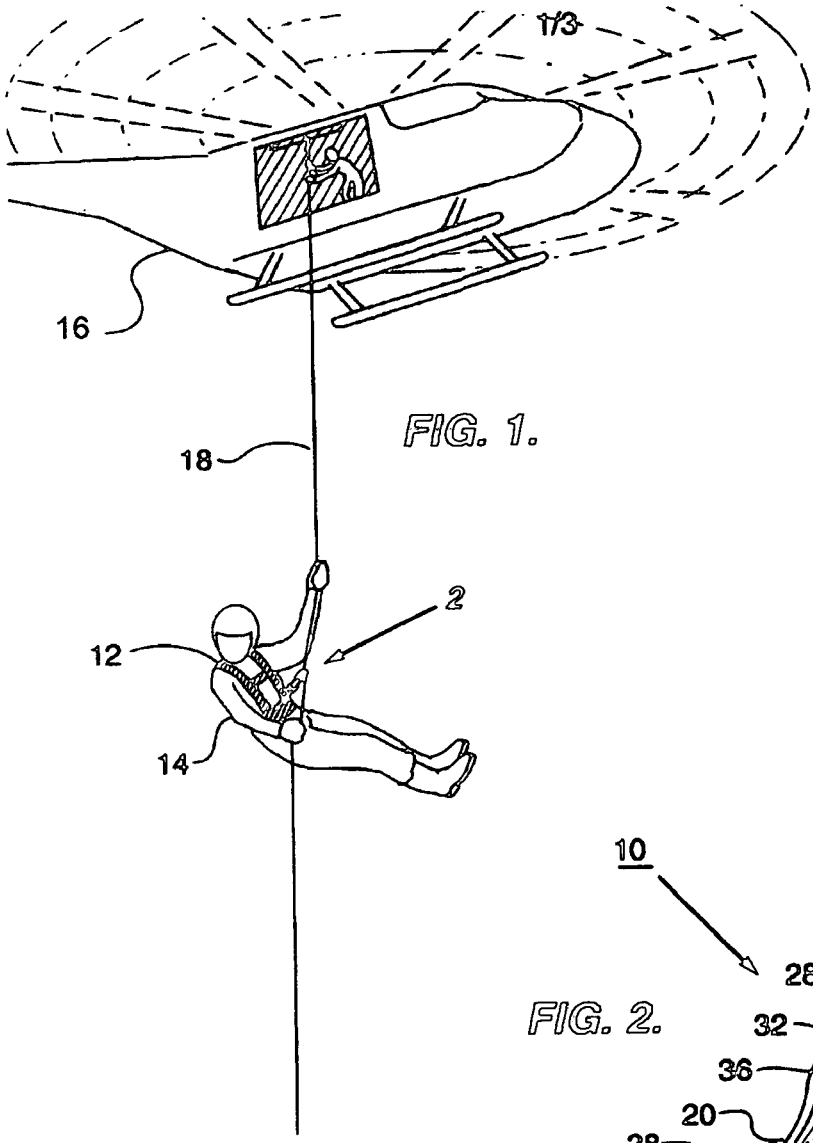
FIG. 1 is a perspective view of the an individual using the present invention to rappel from a helicopter.

Referring more particularly to the drawings by characters of reference, FIGS. 1–4 disclose combinations of features which constitute the components of a rappel device 10 of the present invention. As shown in FIG. 1, rappel device 10 is attached to straps 11 of a harness 12 worn by an individual 14 for rapid descent from a high position, in the illustrated example, a helicopter 16 to a low position (not shown) via a rope 18 anchored inside helicopter 16.

Rappel device 10 is used in rapidly descending from a height using rope 18 and then quickly disengaging from rope 18. Rappel device 10 comprises a body 20 having a rim 23 which defines a rope opening 22 therein. Body 20 is further adapted to be affixed to harness 12. A lock 26 extends across rope opening 22. Lock 26 frictionally engages rope 18 extending through rope opening 22. A retracting mechanism 38 manually releases lock 26 from engagement with rope 18. Retracting mechanism 38 is biased to a secured position whereby lock 26 is engaged with rope 18. Retracting mechanism 38, when actuated, manually releases lock 26 to an open position whereby rope 18 is quickly released from lock 26.

Figure 2:
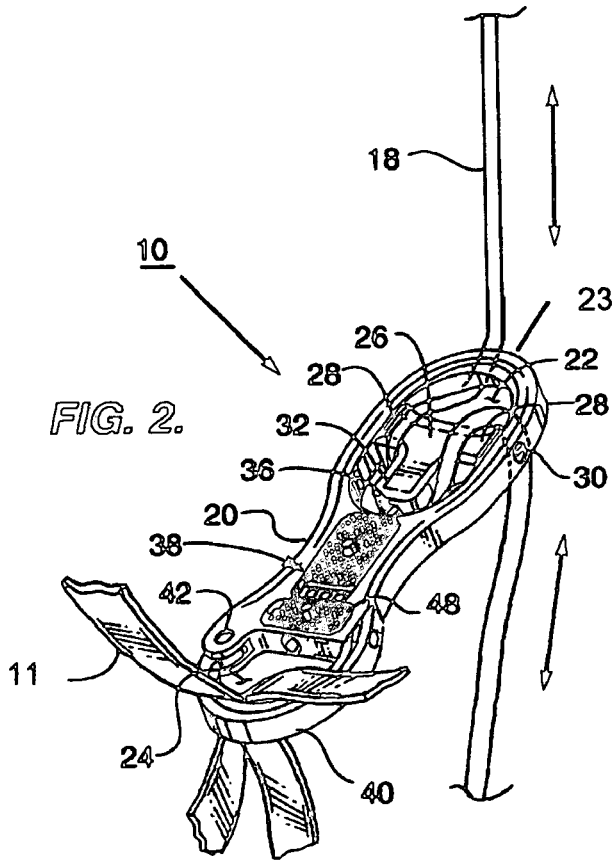
FIG. 2 is a close up perspective view of the present invention in use as denoted by the numeral 2 in FIG. 1 with an arc and a T-lock in a secured position.
Figure 3:
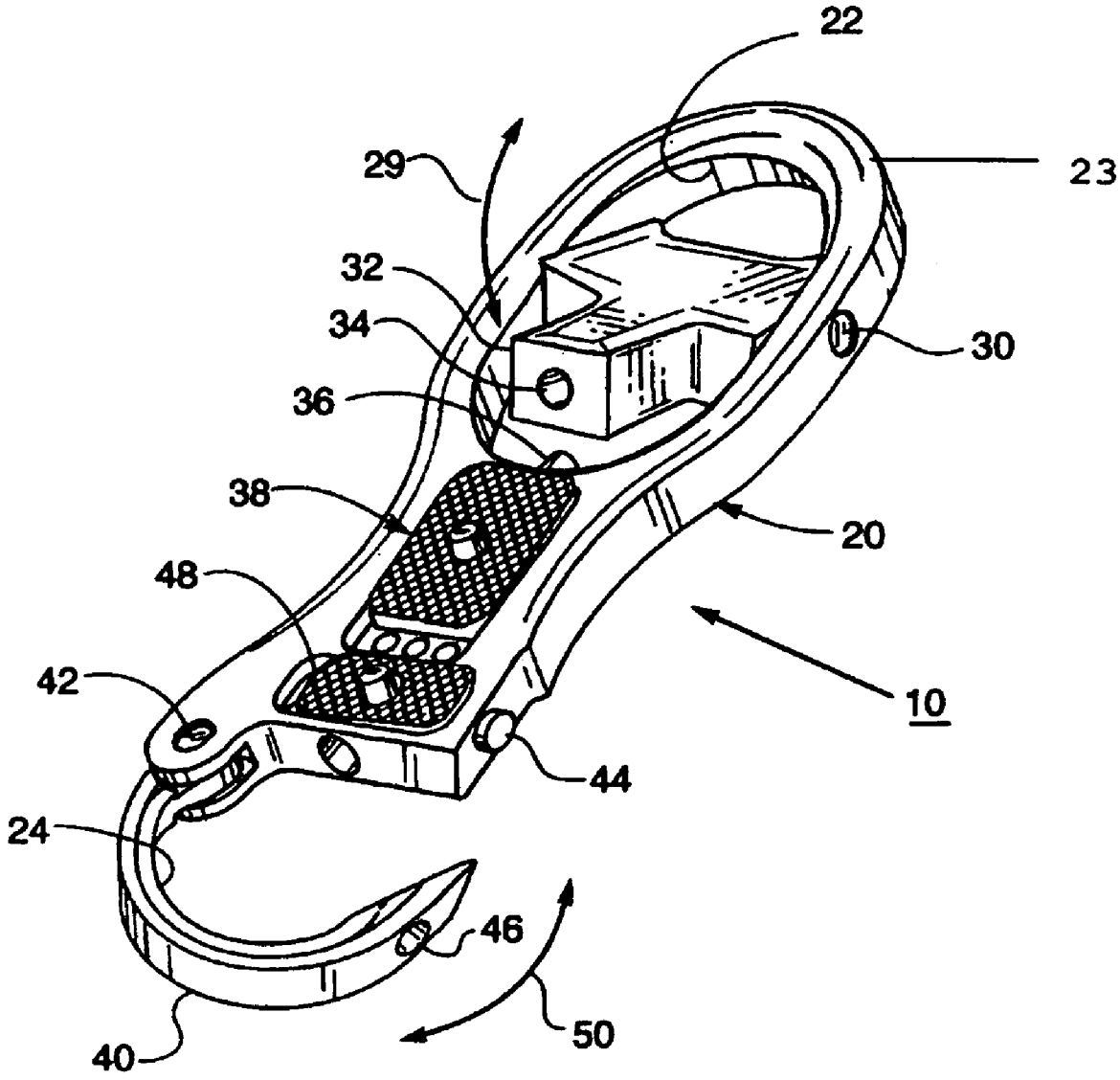
FIG. 3 is a close up perspective view of the present invention in use as denoted by the numeral 2 in FIG. 1 with an arc and a T-lock in an open position.

In the most preferred embodiment, rappel device 10, as best seen in FIGS. 2 and 3, comprises elongated body 20 having rim 23 defining rope opening 22 at one end thereof and a harness opening 24 at the other end. In the illustrated embodiment, rope opening 22 is an oval shape with a long axis longitudinally oriented to body 20 while harness opening 24 is generally a semicircular shape.

In the preferred embodiment, lock 26 is a T-lock is positioned within rope opening 22 with arms 28 extending laterally across said rope opening. A pivot 30 extends through arms 28 from one side of rope opening 22 to the other side thereof thereby allowing free rotation of T-lock 26 about its arms 28 as shown by arrow 29 in FIG. 3.

A leg 32 of T-lock 26 extends laterally from arms 28. Rope opening 22 is long enough to allow leg 32 to freely rotate without contacting rim 23. A T-lock pin receiving cavity 34 is at the bottom of leg 32 which is long enough to receive a retractable T-lock pin 36 extending from housing 20. T-lock pin 36 is biased to a secured position by extending from housing 20 to engage T-lock pin receiving cavity 34 as shown in FIG. 2. However, when T-lock pin 36 is retracted, the end thereof is flush with housing 20 in an open position that allows free rotation of T-lock 26 as shown in FIG. 3. A T-lock pin retracting mechanism 38, described in more detail below, allows individuals to manually retract T-lock pin 36 when desired.

In the illustrated preferred embodiment, harness opening 24 is formed by an arc 40 which is mounted at one end thereof to a hinge 42 on housing 20. Laterally opposite hinge 42 is a second pin 44 which is biased to extend laterally outward from housing 20. Second pin 44 is adapted to engage a second pin receiving cavity 46 on arc 40. When arc 40 is engaged to a secure position with second pin 44 received within second pin receiving cavity 46, harness opening 24 is formed. A second pin retracting mechanism 48, described in more detail below, allows the user to manually retract second pin 44 to an open position which releases said pin from second pin receiving cavity 46 thereby allowing arc 40 to freely rotate about hinge 42 as shown by arrow 50 in FIG. 3.

In use, as seen in FIG. 2, both T-lock pin 36 and second pin 44 are engaged in the secure position. Straps 11 of harness 12 are looped through harness opening 24, usually before engaging second pin 44, thereby securing device 10 thereto. Rope 18 is threaded through rope opening 22 and around T-lock 26. Specifically, from the anchor, rope 18 loops under rim 23 into rope opening 22 between arms 28 of T-lock 26 and rim 23. Rope 18 loops over arm 28 of T-lock 26, then under and around leg 32 and back over the other arm 28, through rope opening 22 between arms 28 of T-lock 26 and rim 23. Those skilled in the art will recognize this rope path is similar to the path followed by such friction devices as a figure eight device which allows the user to control speed of descent.

Once on the ground, the user simply actuates T-lock pin retracting device 38 which disengages T-lock pin 36 from T-lock pin retaining cavity 34. In this open position, T-lock 26 rotates about arms 28 thereby releasing rope 18 from the loop over leg 32 which, in turn, completely frees rope 18 from device 10.

Figure 4:
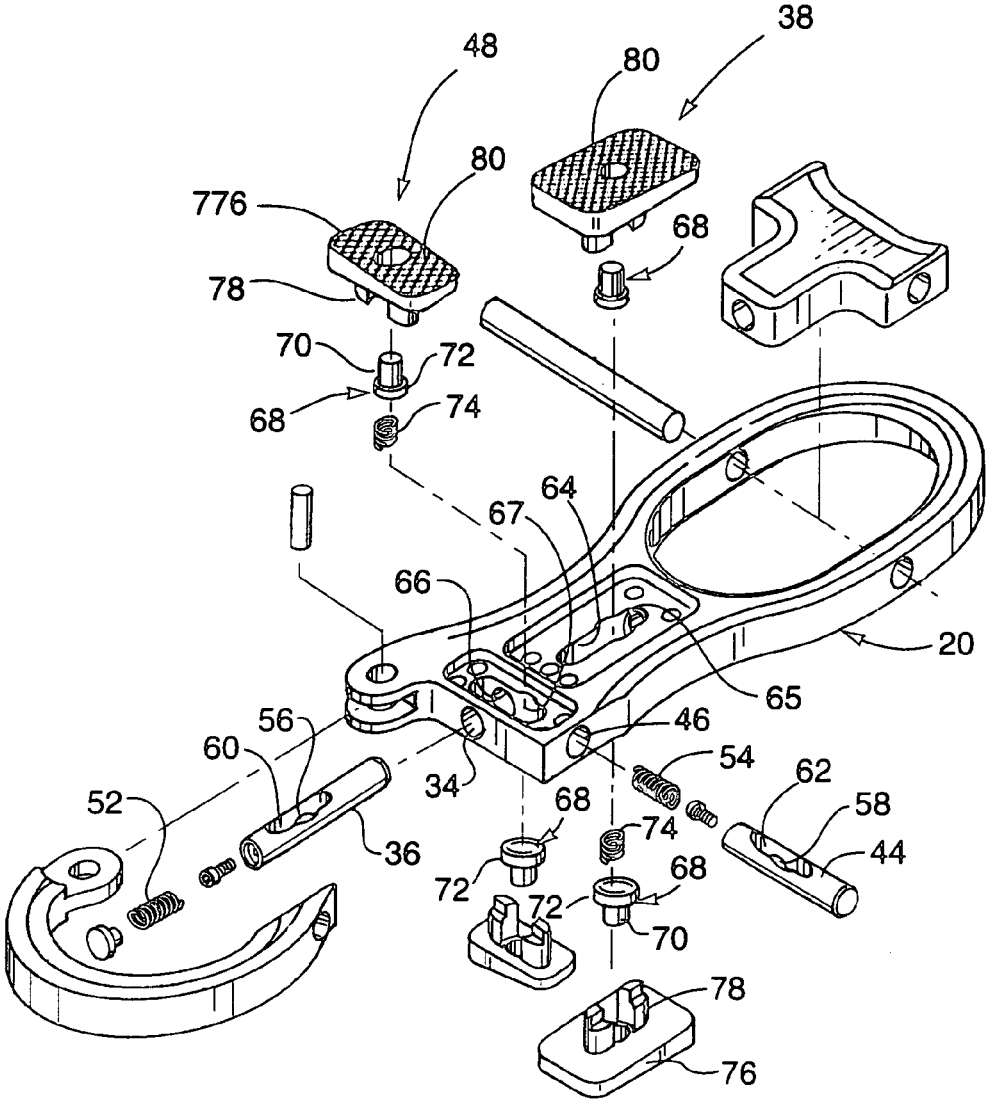
FIG. 4 is an exploded view of the present invention

Turning now to FIG. 4, T-lock pin retracting mechanism 38 and second pin retracting device mechanism 48 employ the same elements but are oriented at right angles to each other as illustrated. Both T-lock pin 36 and second pin 44 are received within generally cylindrical T-lock pin receiving cavity 34 and second pin receiving cavity 46, respectively, which are placed in body 20 between openings 22 and 24. A T-lock pin spring 52 and a second pin spring 54 are positioned in the distal end of T-lock pin receiving cavity 34 and second pin receiving cavity 46, respectively, to bias T-lock pin 36 and second pin 44 to the secure position.

T-lock pin 36 and second pin 44 have longitudinally oriented and generally oval shaped T-lock pin slot 56 and second pin slot 58 extending laterally therethrough. Slots 56 and 58 include a pair of T-lock pin slot wing openings 60 and a pair of second pin slot wing openings 62, respectively, each of the pair of openings 60 and 62 being oppositely positioned along the long axis of slots 56 and 58, respectively, and extend through T-lock pin 36 and second pin 44.

Body 20 defines a pair of T-lock slots 64 and a pair of second slots 66, said slots including T-lock slot wing openings 65 and second slot wing openings 67, on opposing sides of body 20 which mate with corresponding T-lock pin slots 56 and second pin slots 58. When T-lock slots 64 are aligned with T-lock pin slots 56 and second slots 66 are aligned with second pin slot 58, a continuous opening is created from one side of body 20 to the other.

Buttons 68 comprise a thin shaft 70 concentrically aligned with a wider head 72. Head 72 is a squat cylinder shape having a diameter wider than that of shaft 70. Dimensionally, the diameter of head 72 fits within T-lock pin slot wing openings 60, second pin slot wing openings 62, T-lock slot wing openings 65 and second slot wing openings 67, but is too wide to move longitudinally along T-lock slots 64 and second slots 66. In contrast, the diameter of thin shaft 70 is small enough to allow longitudinal movement along T-lock slots 64 and second slots 66.

A first pair of buttons 68 are inserted head 72 first into T-lock pin slot wing openings 60 and T-lock slot wing openings 65, one each from opposing sides of body 20. A second pair of buttons 68 are inserted head 72 first into second pin slot wing openings 62 second slot wing openings 67, one each from opposing sides of body 20. Two button springs 74 are positioned and captured between each pair buttons 68 which resiliently bias buttons 68 outward from said slots.

Each outwardly extending thin shaft 70 extends through a guide 78 to a wide button 76. In the preferred embodiment, the side of wide button 76 opposite guide 78 provides a gun knurl surface 80 for ease of manual contact. When assembled, each head 72 is positioned within T-lock slot wing openings 65 or second slot wing openings 67 which hereby prevent longitudinal movement of T-lock pin 36 and second pin 44. Further, in this position, T-lock pin 36 and second pin 44 are in the secured position engaged with T-lock pin receiving cavity 34 and second pin receiving cavity 46, respectively.

To actuate retracting mechanisms 38 or 48, a user presses on wide buttons 76 on both sides of body 20 which compresses button spring 74. The compression brings opposing heads 72 closer together whereby heads 72 eventually disengage from either T-lock slot wing openings 65 or second slot wing openings 67 depending upon which retracting mechanism 38 or 48 is actuated. Once disengaged, thin shaft 70 does allow longitudinal movement to slide T-lock pin 36 or second pin 44 to the open position whereby T-lock 26 or arc 40, respectively, is free to rotate.

Those skilled in the art will recognize that the present invention is not meant to be limited to the specific shapes and structures described. Other shapes and structures can be employed without departing from the scope of the intended invention. For example, a cover can be placed over wide buttons 76 or buttons 68 to prevent entry of dirt and dust which may impair the working of the retracting mechanisms. The key to the present invention is the use of a manually operated mechanism for releasing rope 18 easily and quickly.

Although only certain embodiments have been illustrated and described, it will be apparent to those skilled in the art that various changes and modifications may be made therein without departing from the spirit of the invention or from the scope of the appended claims.

What is claimed is:

1. A rappel device adapted for use in rapidly descending from a height using a rope and thereafter allowing quick disengagement from the rope, the rappel device comprising:

a body having a rim defining a rope opening therein, the body further adapted to be affixed to a harness, a lock extending across the rope opening, the lock adapted to frictionally engage a rope extending through the rope opening, the lock being a T-lock with two arms and a leg, the arms extending laterally across the rope opening, the arms having a pivot extending therethrough, the pivot allowing the T-lock to freely rotate about the arms, the leg extending laterally from the arms, the leg being short enough to avoid contact with the rim when the T-lock is freely rotating, the leg being secured to and released from the rim by the retracting mechanism, the retracting mechanism biased to a secured position whereby the lock is adapted to be engaged with a rope, the retracting mechanism manually releasing the lock to an open position whereby the lock is adapted to release a rope from engagement therewith, the retracting mechanism comprising a T-lock pin extending from the rim adapted to be secured to a T-lock pin receiving cavity in the leg, the retracting mechanism retracting the T-lock pin whereby the end thereof is flush with the rim in the open position thereby allowing free rotation of the T-lock, the T-lock pin having a longitudinally oriented and generally oval shaped T-lock pin slot extending laterally therethrough, the T-lock pin slot further having a pair of T-lock pin slot wing openings being oppositely positioned along the long axis of the T-lock pin slot and extending laterally through the T-lock pin, the body defining a pair of T-lock slots, each of the slots including T-lock slot wing openings on opposing sides of the body, the T-lock slots mating with the T-lock pin slots when the T-lock slots are aligned with the T-lock pin slots, two buttons which include a thin shaft concentrically aligned with a wider head, the head being a cylindrical shape having a diameter wider than that of the thin shaft, the diameter of the head being narrow to fit within the T-lock pin slot wing openings and the T-lock slot wing openings, the diameter of the head being too wide to move longitudinally along the T-lock pin slot and the T-lock slots, the diameter of the thin shaft being small enough to allow longitudinal movement along the T-lock pin slot and the T-lock slots, the two buttons being inserted headfirst into the T-lock pin slot and the T-lock slot from opposing sides of the body, two button springs being are positioned and captured between the two buttons thereby resiliently biasing the buttons outward therefrom, the two thin shafts extending to a wide button, the two heads being positioned within the T-lock slot wing openings thereby preventing longitudinal movement of the T-lock pin with the T-lock pin in the secured position engaged with the T-lock pin receiving cavity, whereby pressing on the wide buttons on both sides of the body compresses the button spring thereby bringing the two heads closer together whereby the heads disengage from the T-lock slot wing openings whereby the thin shafts do allow longitudinal movement to slide T-lock pin to the open position whereby the T-lock is free to rotate.

2. The rappel device of claim 1 wherein further comprising a T-lock pin spring positioned to bias the T-lock pin to the secure position.

3. A rappel device adapted for use in rapidly descending from a height using a rope and thereafter allowing quick disengagement from the rope, the rappel device comprising:

an elongated body having a rim defining a rope opening at one end thereof, and a harness opening at the other end, the harness opening adapted to be affixed to a harness, the harness opening being formed by an arm with a hinge at one end thereof, the hinge being mounted to the body, the other end of the arm being releasably secured to the body by a pin extending from the body, the pin engaging a pin receiving cavity in the arm to secure said arm to the body, a pin retracting mechanism allowing the pin to retract into the body thereby releasing the arm therefrom to rotate freely about the hinge, the body and the arm forming, in combination, the harness opening, a T-lock with two arms and a leg, the arms extending laterally across the rope opening, the arms having a pivot extending therethrough, the pivot allowing the T-lock to freely rotate about the arms, the leg extending laterally from the arms, the leg being short enough to avoid contact with the rim when the T-lock is freely rotating, the leg being secured to and released from the rim by a retracting mechanism, the arms and the leg adapted to frictionally engage a rope extending through the rope opening, the retracting mechanism for manually releasing the leg from the rim thereby disengaging the T-lock from engagement with the rim and allowing the T-lock to freely rotate about the pivot, the retracting mechanism biased to a secured position whereby the T-lock is engaged with the rim, the retracting mechanism manually releasing the T-lock to an open position whereby the T-lock is not engaged with the rim, the retracting mechanism including a T-lock pin extending from the rim adapted to be secured to a T-lock pin receiving cavity in the leg, the T-lock pin being biased to the secured position wherein the T-lock pin engages the T-lock pin receiving cavity, wherein the retracting mechanism retracts the T-lock pin whereby the end thereof is flush with the rim in the open position thereby allowing free rotation of the T-lock, the T-lock pin having a longitudinally oriented and generally oval shaped T-lock pin slot extending laterally therethrough, the T-lock pin slot further having a pair of T-lock pin slot wing openings being oppositely positioned along the long axis of the T-lock pin slot and extending laterally through the T-lock pin, the body defining a pair of T-lock slots, each of the slots including T-lock slot wing openings on opposing sides of the body, the T-lock slots mating with the T-lock pin slots when the T-lock slots are aligned with the T-lock pin slots, two buttons which include a thin shaft concentrically aligned with a wider head, the head being a cylindrical shape having a diameter wider than that of the thin shaft, the diameter of the head being narrow to fit within the T-lock pin slot wing openings and the T-lock slot wing openings, the diameter of the head being too wide to move longitudinally along the T-lock pin slot and the T-lock slots, the diameter of the thin shaft being small enough to allow longitudinal movement along the T-lock pin slot and the T-lock slots, the two buttons being inserted headfirst into the T-lock pin slot and the T-lock slot from opposing sides of the body, two button springs being are positioned and captured between the two buttons thereby resiliently biasing the buttons outward therefrom, the two thin shafts extending to a wide button, the two heads being positioned within the T-lock slot wing openings thereby preventing longitudinal movement of the T-lock pin with the T-lock pin in the secured position engaged with the T-lock pin receiving cavity, whereby pressing on the wide buttons on both sides of the body compresses the button spring thereby bringing the two heads closer together whereby the heads disengage from the T-lock slot wing openings whereby the thin shafts do allow longitudinal movement to slide T-lock pin to the open position whereby the T-lock is free to rotate, a T-lock pin spring positioned within the T-lock pin receiving cavity to bias T-lock pin to the secure position.

4. The rappel device of claim 3 wherein the arm is an arc.

* * * * *